US012228029B2

(12) United States Patent
Fripp et al.

(10) Patent No.: US 12,228,029 B2
(45) Date of Patent: Feb. 18, 2025

(54) WIRELESS TRANSMISSION AND RECEPTION OF ELECTRICAL SIGNALS VIA TUBING ENCASED CONDUCTOR

(71) Applicant: Halliburton Energy Services, Inc., Houston, TX (US)

(72) Inventors: Michael Linley Fripp, Singapore (SG); Luke William Holderman, Singapore (SG); Paul James, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 31 days.

(21) Appl. No.: 17/690,514

(22) Filed: Mar. 9, 2022

(65) Prior Publication Data

US 2023/0287787 A1 Sep. 14, 2023

(51) Int. Cl.

| | |
|---|---|
| ***E21B 47/13*** | (2012.01) |
| ***E21B 17/02*** | (2006.01) |
| ***E21B 41/00*** | (2006.01) |

(52) U.S. Cl.

CPC ..... *E21B 47/13* (2020.05); *E21B 17/0283* (2020.05); *E21B 41/0085* (2013.01)

(58) Field of Classification Search

CPC ... E21B 47/13; E21B 17/0283; E21B 41/0085
See application file for complete search history.

(56) References Cited

U.S. PATENT DOCUMENTS

| | | | | |
|---|---|---|---|---|
| 4,525,715 | A | 6/1985 | Smith | |
| 5,908,365 | A * | 6/1999 | LaJaunie | E21B 43/11852 166/299 |
| 5,942,990 | A | 8/1999 | Smith et al. | |
| 6,392,561 | B1 * | 5/2002 | Davies | E21B 4/02 340/854.3 |
| 7,168,487 | B2 | 1/2007 | Salamitou et al. | |
| 2017/0336525 | A1 | 11/2017 | Wilson et al. | |
| 2019/0044574 | A1 | 2/2019 | Majid | |
| 2019/0195028 | A1 | 6/2019 | Fripp et al. | |
| 2019/0353031 | A1 * | 11/2019 | Logan | H04L 1/0045 |
| 2020/0092199 | A1 * | 3/2020 | Freeman | H04L 43/0817 |
| 2021/0032960 | A1 * | 2/2021 | Breerwood | E21B 47/12 |
| 2021/0189845 | A1 * | 6/2021 | Jabari | E21B 43/117 |

FOREIGN PATENT DOCUMENTS

| | | | |
|---|---|---|---|
| EP | 2723985 | B1 | 3/2017 |

OTHER PUBLICATIONS

PCT Application No. PCT/US2022/019540 , "International Search Report and Written Opinion", Dec. 1, 2022, 11 pages.

* cited by examiner

*Primary Examiner* — D. Andrews

(74) *Attorney, Agent, or Firm* — Kilpatrick Townsend & Stockton LLP

(57) ABSTRACT

A system comprising a tubing encased conductor (TEC), a transformer inductively coupled to the TEC, and a wireless downhole device coupled to the transformer. The wireless downhole device may include a transceiver configured to receive and/or transmit, from the transformer, a digital signal encoded in a variable current in the TEC. The digital signal may correspond to a command. In some aspects, the wireless downhole device may be powered via the transformer, a battery, or a turbine.

18 Claims, 6 Drawing Sheets

WIRELESS TRANSMISSION AND RECEPTION OF ELECTRICAL SIGNALS VIA TUBING ENCASED CONDUCTOR

TECHNICAL FIELD

The present disclosure relates generally to wellbore completion operations and, more particularly (although not necessarily exclusively), to tubing encased conductors.

BACKGROUND

Tubing encased conductors (TECs) are placed downhole in a wellbore for providing power to downhole devices from the surface and transmitting data from downhole devices back to the surface. Downhole devices may include but are not limited to sensors. It can be desirable to place sensors at multiple locations along the wellbore. Placement of each sensor along the TEC can require creating a splice, join, or new termination in the TEC. Each sensor can require as many as three points for connecting to a power cable in the TEC. This results in at least one, and potentially three points where the integrity of the TEC is breached and sealed. Each of these points is at risk of leaking wellbore fluids into the core of the TEC, which may result in a short circuit. A single leak could cause failure of an entire downhole system powered by the TEC. The reliability of the entire downhole system powered by the TEC may be depend on the reliability of these points.

DETAILED DESCRIPTION

Figure 1:
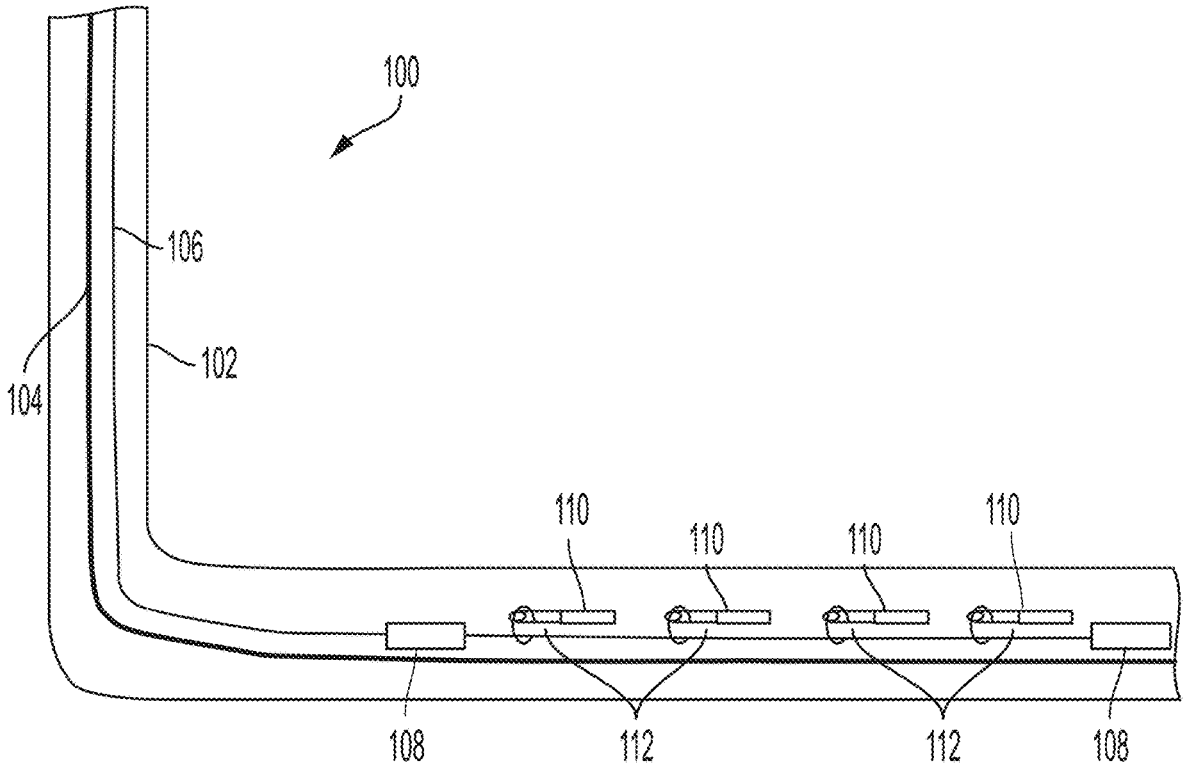
FIG. 1 is a schematic diagram of a well system including a wellbore extending through a subterranean formation, a casing string extends within the wellbore according to one example of the present disclosure.

Certain aspects and examples of the present disclosure relate to wireless transmission and reception of electrical signals to a device positioned downhole, for example but not limited to a sensor, via a TEC without a wired connection between the device and the TEC. A TEC may contain at least one electrical conductor within a metal tubing. The metal tubing may provide the at least one electrical conductor protection from abrasion and protection from fluids. The electrical conductor may carry power and data to downhole tools. Connecting a downhole tool to the TEC may, in some instances, require cutting the tubing, connecting the electrical conductor to the downhole tool, and wielding the tubing to the body of the downhole tool. Such a process can be expensive and time consuming. The present disclosure teaches methods and assemblies for transmitting data (i.e. transmission and/or reception of digital signals corresponding to commands or data) between a downhole device and a TEC and/or providing power to the downhole device from a TEC without hardwiring the downhole device to the TEC. Current may produce a magnetic field around a wire that is characteristic of the current within the wire. The magnetic field around the wire may provide power to the downhole device or may correspond to data being transmitted to the downhole device. Also, altering or producing a magnetic field around the wire may produce or influence the current within the wire. The magnetic field produced or altered around the wire may impart data via influencing the current in the wire.

Wireless transmission and reception of electrical signals between a downhole device and a TEC may improve wellbore systems' functioning by alleviating the need to physically hardwire the downhole device to the TEC which may cause damage to the TEC thus negatively impacting the functioning of the well system. Wireless transmission and reception of electrical signals along the TEC may also allow for finer control of production in the well system by using wired electronics, such as electronic inflow control valves (eICVs) to act as data hubs for wireless downhole devices. For example, eICVs, wired to the TEC, could receive electrical signals from nearby wireless sensors instead of the wireless sensors having to send signals to the surface, providing a short hop for communication between the wireless sensors and the EICV's electrical signal.

Transmitting and receiving electrical signals locally, via a network of wired and wireless downhole tools could also allow for a faster means of communication than transmitting every signal to the surface and receiving every signal from the surface via the TEC. The potential for increased speed in transmitting and receiving electrical signals may be explained by an increase in bandwidth that may be afforded by higher frequency signals sent and received locally. Higher frequency signals may be better suited for higher bandwidth applications than lower frequency signals, whereas lower frequency signals may be better suited to retaining coherence along a significant distance, such as a path from a down-well tool to the surface.

The electrical signals, received or transmitted wirelessly or with a wired connection to the TEC, may control any downhole device. For instance, data from a sensor wirelessly interfacing with the TEC could instruct a wired EICV to open, close, or adjust fluid flow through the EICV. In other examples a wireless downhole device may transmit via electrical signals commands to another downhole device or tool related to a hydrostatic system, setting a production packer, setting a sliding sleeve operable to provide a flowpath between an oilfield tubular and an annulus of a wellbore, or actuating a disconnect reel, or other command. Examples of oilfield tubulars include jointed pipe and coiled tubing.

The electrical signals may include data (including commands) that may be encoded in varying current amperage, voltage amplitude shifts, voltage phase shifts, voltage frequency shifts, timing shifts or other characteristics of alternating currents present within at least one alternating current within a TEC. Alternating current may be a time varying current where the frequency of the varying current is greater than 50 Hz. Data (including commands) may be encoded in varying current amperage of a direct current present within the TEC. Direct current may be a quasi-static current that may have a non-zero average current value. Data encoding may be achieved by varying voltage at a voltage source at the surface from which the TEC originates. The data encoded in the alternating current within a TEC may accompany an alternating current of a different frequency, used for power transmission. Also, the data encoded in the alternating current within a TEC may accompany a direct current used for power transmission.

Data encoded in alternating variable current within the TEC may be received as variations in a resulting magnetic field by a magnetic field sensor. In some examples, variations in the resulting magnetic field may be received by a magnetometer that measures magnetic field. In one example, the magnetometer is a transformer. The transformer may include but is not limited to a ferromagnetic ring that may surround the TEC such that the magnetic field created by the current within the TEC passes through the ferromagnetic ring. The transformer may also include a wire coil around the ferromagnetic ring that may transfer the magnetic flux passing through the ferromagnetic ring into electrical current representative of the data encoded in the current within the TEC. In some examples, the ferromagnetic ring may include ferrite though any suitable ferromagnetic material may be used. The term ferromagnetic is intended to include ferrimagnetic and paramagnetic behaviors. Additional examples of ferromagnetic materials include nickel-iron alloys such as Permalloy and mu-metal, iron, steel, and nickel.

Energy may be harvested from an alternating current within the TEC by a transformer. The transformer may include a ferromagnetic ring that may surround the TEC such that the magnetic field created by the current within the TEC passes through the ferromagnetic ring. The transformer may also include a wire coil around the ferromagnetic ring that may convert the magnetic flux passing through the ferromagnetic ring into electrical current that may be sufficient to power at least one downhole tool, sensor, control valve, or other device. The sensor may operate at a higher voltage and lower current than that of the TEC.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic diagram of a well system 100 including a wellbore extending through a subterranean formation, a casing string 102 extends within the wellbore according to one example of the present disclosure. A tubular 104 may extend within the casing string 102. The well system 100 may also include a plurality of wireless devices 110, which may be for example but not limited to sensors. A TEC 106 extends downhole and a plurality of wired devices 108 are hardwired to the TEC 106. In some aspects, the TEC 106 may be positioned between an outer surface of the tubular 104 and the inner surface of the casing string 102. As shown in FIG. 1, in some aspects, the wireless devices 110 may each be wireless coupled to the TEC 106 via a transformer (shown as ferromagnetic rings 112), for example for powering the wireless devices 110 via the TEC 106. In some examples, the ferromagnetic rings 112 may include ferrite, though other suitable ferromagnetic materials may be used.

Figure 2A:
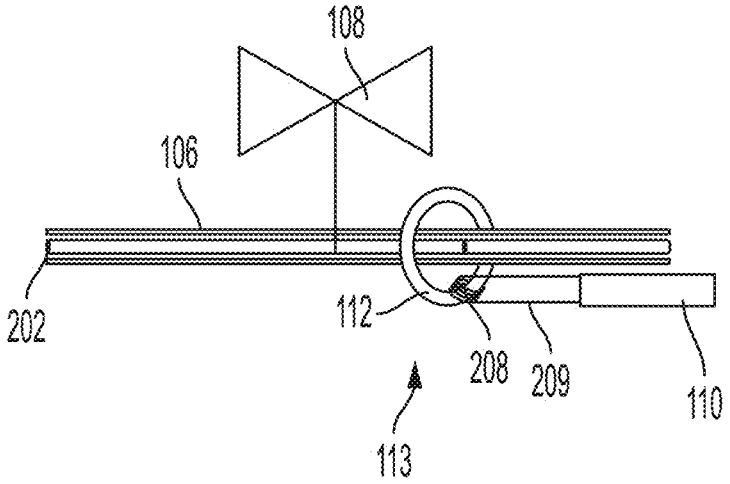
FIG. 2A is a portion of the schematic diagram of the well system depicted in FIG. 1 including one of the wireless devices and a transformer for receiving an electrical signal from the TEC without hardwiring the wireless device into the TEC according to one example of the present disclosure.
Figure 2B:
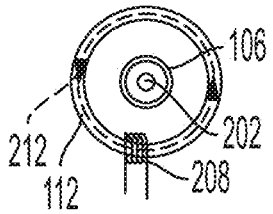
FIG. 2B is an alternative view of the TEC and transformer from FIG. 2A according to one example of the present disclosure.

FIG. 2 is a portion of the schematic diagram of the well system 100 depicted in FIG. 1 including one of the wireless devices 110 and a transformer 113, for receiving an electrical signal from the TEC 106 without hardwiring the wireless device 110 into the TEC 106 according to one example of the present disclosure. The transformer 113 as illustrated includes a ferromagnetic ring 112 encircling the TEC 106, and a coil 208 of wire 209 wrapped around the ferromagnetic ring 112. As an AC current, illustrated as 'i,' passes through an electrical conductor 202 within the TEC 106, magnetic flux lines are concentrated in the ferromagnetic ring 112. The coil 208 of wire 209 wraps around the ferromagnetic ring 112 and captures part of the magnetic field caused by the AC current thereby capturing some of the electrical energy from the TEC 106. The coil 208 is also coupled to the wireless device 110 for transmitting power from the AC current flowing through the TEC 106 to the wireless device 110 for powering the wireless device 110. The wireless device 110 may include a sensor that relays a measurement such as pressure, temperature, chemical composition, pH, water composition, or other characteristic. In some examples, the wireless device 110 may relay data related to the health or operational status of the wired device 108 which may in some examples be a downhole tool. A wired device 108 is electrically connected to the electrical conductor 202 within the TEC 106. The wired device 108 may include an inflow control valve, a hydrostatic setting system, a control device for setting a packer, a control device for setting a sliding sleeve, an actuator for disconnecting a tool, or other downhole device.

The AC current within the electrical conductor 202 may be on top of a DC current flowing within the electrical conductor 202. Data may be encoded in varying current amperage, voltage amplitude shifts, voltage phase shifts, voltage frequency shifts, timing shifts or other characteristics of the AC current. Data encoding may be achieved by varying voltage at a voltage source above a surface from which the TEC 106 originates. Data encoding may also be achieved by encoding an AC current created downhole by the wired device 108. Examples of encoded data may include but are not limited to data corresponding to draw down rate flow rate, fluid viscosity, pressure, temperature, chemical composition, potential of hydrogen (pH) values, water composition, or operational status of the wired device 108

The magnetic field 212 produced within the ferromagnetic ring 112 by the current 200 may possess a time-varying magnetic field values that parody the variations in the characteristics of the current 200. The coil 208 may obtain an induced current from the magnetic field 212 produced within the ferromagnetic ring 112. The induced current within the coil 208 may retain values that parody the variations within the current 200 and contain encoded data within the current 200. The induced current may also be sufficient to power the wireless device 110 attached to the ferromagnetic ring 112 by the coil 208.

The wired device 108, may be able to serve as a data hub, capable of receiving data form the surface or transmitting data to the wireless device 110. The wireless device 110 may be calibrated to accept electrical signals either associated with a particular channel or associated with a channel specific to the wireless device 110. A turbine may be placed proximal to the wireless device 110 for the purpose of supplying energy to the wireless device 110.

Figure 3A:
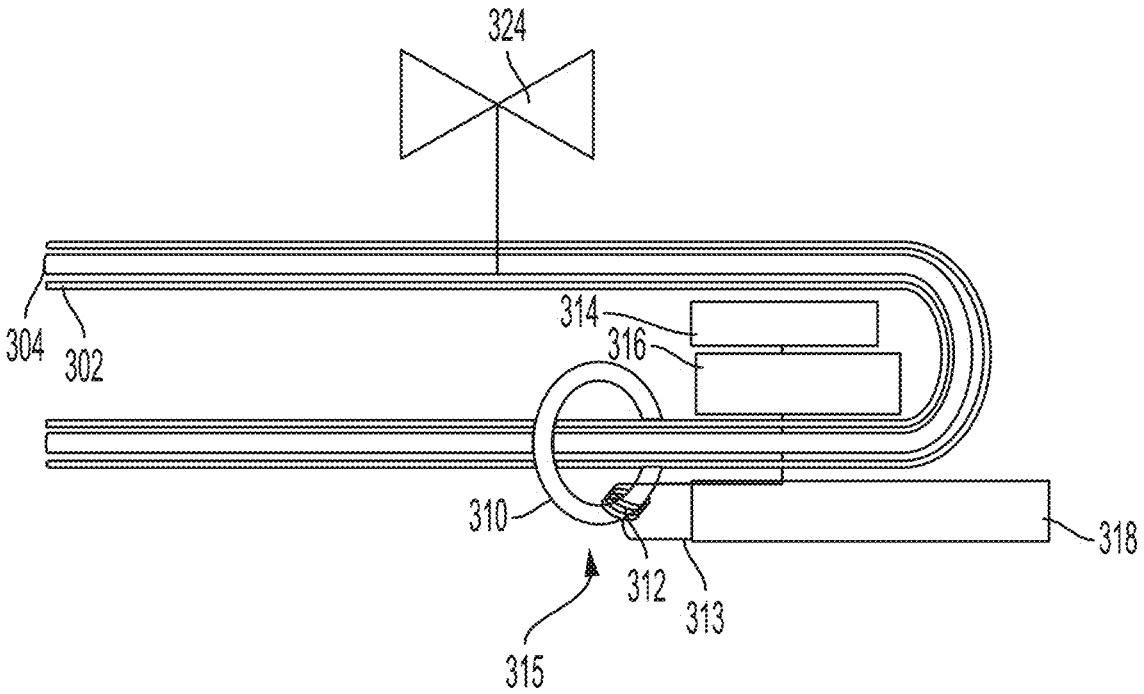
FIG. 3A is a schematic diagram of a portion of a well system including a voltage source, a capacitor, a ferromagnetic ring, and a coil of wire for transmitting an electrical signal from the wireless device uphole through the TEC without hardwiring the wireless device into the TEC according to one example of the present disclosure.
Figure 3B:
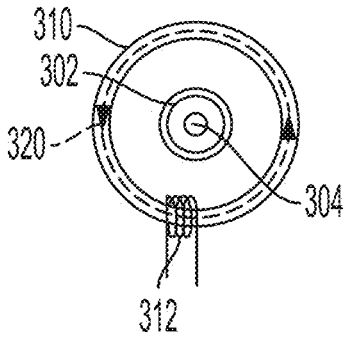
FIG. 3B is an alternate view of the TEC and transformer from FIG. 3A according to one example of the present disclosure.

FIG. 3 is a schematic diagram of a portion of a well system including a voltage source 318, a capacitor 316, a ferromagnetic ring 310, and a coil 312 of wire 313 for transmitting an electrical signal from the wireless device 314 uphole through the TEC 302 without hardwiring the wireless device 314 into the TEC 302 according to one example of the present disclosure. A current, illustrated as 'i,' may pass through an electrical conductor 304 within a TEC 302. The TEC 302 originates from a surface. The ferromagnetic ring 310 encircles the TEC 302. The ferromagnetic ring 301 is connected to the voltage source 318 by wire 313 that originates from the voltage source 318, forms the coil 312 around the ferromagnetic ring 310, and terminates back into the voltage source 318. The combination of the ferromagnetic ring 310 and the coil 312 may constitute a transformer 315. The coil 312 of the transformer 315 may be comprised of a plurality of windings of wire 313, whereas the wire 313 may connect to the voltage source 318 directly. Other geometries of transformer, such as an autotransformer or a laminated core transformer, may replace the transformer 315 containing the ferromagnetic ring 310 and the coil 312. The voltage source 318 is electrically connected to the capacitor 316. The capacitor 316 is electrically connected to a wireless device 314 that is not hardwired to the TEC 302. The wire. The wireless device 314 may include a sensor that relays a measurement such as pressure, temperature, chemical composition, pH, or water composition. The wireless device 314 may receive data related to the health or operational status of the wired device 324. A wired device 324 is electrically connected to the electrical conductor 304 within the TEC 302. The wired device 324 may include an inflow control valve, a hydrostatic setting system, a control device for setting a packer, a control device for setting a sliding sleeve, an actuator for disconnecting a tool, or a sensor that relays a measurement such as pressure, temperature, chemical composition, pH, or water composition.

The transformer 315 may create an AC magnetic flux that is concentrated in the ferromagnetic ring 310. The AC magnetic field may create an AC current in the coil 312. The transformer 315 may inject an AC electrical signal into the TEC 302. The transformer 315 may create a short-duration AC current within the TEC 302. A resulting AC current could be at a different frequency than a power frequency, which may be detected with greater fidelity uphole. The resulting AC current can even be an AC signal on a DC within the TEC 302. Electrical energy could be collected in a capacitor bank to accumulate sufficient energy to amplify a signal of greater fidelity. The transformer 315 can use a time-varying magnetic field to induce an AC signal in the TEC 302. The current within the electrical conductor 304 may include any combination of alternating currents or direct currents of varying phase or voltage amplitude. Data may be encoded in varying current amperage, voltage amplitude shifts, voltage phase shifts, voltage frequency shifts, timing shifts or other characteristics of alternating currents present within the current.

Data encoding may be achieved by varying voltage at a voltage source above the surface from which the TEC 302 originates. Examples of encoded data may include but are not limited to draw down rate flow rate, fluid viscosity, pressure, temperature, chemical composition, potential of hydrogen (pH) values, water composition, or operational status of the wired device 324. The magnetic field 320 produced within the ferromagnetic ring 310 by the current may possess a time-varying magnetic field that parody the variations in the characteristics of the current.

The wireless device 314 may transmit an electrical signal to the voltage source 318 for amplification. The electrical signal may correspond to a command, a measurement, or other data. The voltage source 318 may use energy stored within the capacitor 316 to amplify the electrical signal across the wire 313 shaped into a coil 312 by providing a bias within the alternating current. An alternative means of energy storage, including but not limited to additional capacitors, at least one chemical battery, or any combination of devices suitable for storing electrical energy may be used in place of the capacitor 316. A turbine may be placed proximal to the wireless device 314 for the purpose of supplying energy to the voltage source 318 or the wireless device 314. The electrical signal transmitted through the coil 312 may alter the magnetic field 320 within the ferromagnetic ring 310 such that changes in the magnetic field 320 parody the electrical signal transmitted through the wire 313. The alterations in the magnetic field 320 may alter characteristics of the electrical signal encoded in the AC current within the TEC 302, thereby encoding the electrical signal originating from the wireless device 314 into the AC current. The AC current containing the electrical signal may be on top of a DC current flowing within the electrical conductor 304 within the TEC 302. Wired electronics may be able to serve as a data hub, capable of receiving data from the surface or receiving data from the wireless device 314. The wireless device 314 may be calibrated to transmit electrical signals either associated with a particular channel or associated with a channel specific to the wireless device 314.

Figure 4:
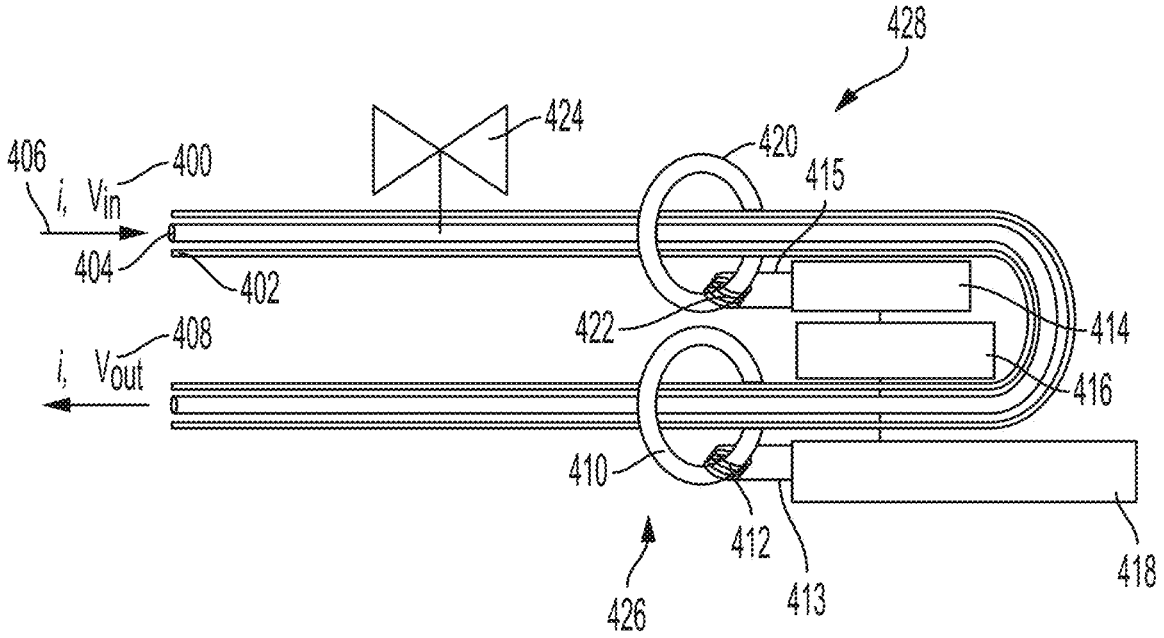
FIG. 4 is a schematic diagram of a portion of a wireless transmission assembly including a sensor coupled to a harvesting transformer and a transmitting transformer, the transformers being wirelessly coupled to a TEC according to one example of the present disclosure.

FIG. 4 is a schematic diagram of a portion of a wireless transmission assembly including a sensor coupled to a harvesting transformer 428 and a transmitting transformer 426, the transformers being wirelessly coupled to a TEC according to one example of the present disclosure. The harvesting transformer 428 may power a wireless device 414 by harvesting AC power from the TEC. The transmitting transformer 426 may transmit data from the wireless device 414 by imparting an AC signal into the TEC. A current 406, possessing an input voltage 400, passes through an electrical conductor 404 within a TEC 402. The TEC originates from a surface. As shown in FIG. 4, the TEC may make a loop and return towards the surface. Alternatively, as shown in FIG. 2, the TEC may be a single line without loops. A transmitting ring 410 encircles the TEC 402. The transmitting ring 410 is disposed below a power harvesting transformer 428, which also encircles the TEC 402. The transmitting ring 410 is connected to a voltage source 418 by wire 413 that originates from the voltage source 418, forms a transmitting coil 412 around the transmitting ring 410, and terminates back into the voltage source 418. The combination of the transmitting ring 410 and transmitting coil 412 may constitute a transmitting transformer 426. The voltage source 418 is electrically connected to a capacitor 416. The capacitor 416 is electrically connected to the wireless device 414. The harvesting ring 420 is connected to the wireless device 414 by wire 415 that originates from the wireless device 414, forms a harvesting coil 422 around the harvesting ring 420, and terminates back into the wireless device 414. The combination of the harvesting coil 422 and the harvesting ring 420 may constitute a harvesting transformer 428. The harvesting transformer 428 may rectify the alternating current into a direct current that may be used by the wireless device 414. In an alternative embodiment, the transmitting ring 410 and the harvesting ring 420 may be replaced by a single ferromagnetic ring, the single ferromagnetic ring being connected to both the transmitting coil 412 and the harvesting coil 422. A wired device is electrically connected to the electrical conductor 404 within the TEC 402.

The current 406 within the electrical conductor 404 may include any combination of alternating currents or direct currents of varying phase or voltage amplitude. A constant resistive load may be placed at either end of the TEC 402. Data may be encoded in varying current amperage, voltage amplitude shifts, voltage phase shifts, voltage frequency shifts, timing shifts or other characteristics of alternating currents present within the current 406. Data encoding may be achieved by varying voltage at a voltage source above the surface from which the TEC originates. Data encoding may also be achieved by changing current flow with the wired device 424. Examples of encoded data may include but are not limited to draw down rate flow rate, fluid viscosity, pressure, temperature, chemical composition, potential of hydrogen (pH) values, water composition, or operational status of the wired device 424. A magnetic field produced within the harvesting ring 420 by the current 406 may possess a time-varying magnetic field that parodies variations in the characteristics of the current 406. The harvesting coil 422 may obtain an induced current from the magnetic field produced within the harvesting ring 420. The induced current within the coil may retain values that parody variations within the current 406 and contain encoded data within the current 406. The induced current obtained at the harvesting coil 422 may also be used to charge the capacitor 416 or another means of electrical energy storage, such as a capacitor bank, a chemical battery, a bank of chemical batteries, or a combination of batteries and capacitors.

The wireless device 414 may transmit an electrical signal to the voltage source 418 for amplification. The voltage source 418 may use energy stored within the capacitor 416 to amplify the electrical signal across the wire 413 shaped into the transmitting coil 412. An alternative means of energy storage, including but not limited to additional capacitors, at least one chemical battery, or any combination of devices suitable for storing electrical energy may be used in place of the capacitor 416. The electrical signal transmitted through the transmitting coil 412 may alter a magnetic field within the transmitting ring 410 such that changes in the magnetic field parody the electrical signal transmitted through the wire 413 shaped into the transmitting coil 412. Alterations in the current 406 may affect an output voltage 408.

Wired electronics, such as the wired device 424 may be able to serve as a data hub, capable of receiving data from the surface, receiving data from the wireless device 414 or similar sensors, transmitting data to the wireless device 414 or similar sensors, and routing data from the wireless device 414 or similar sensors to the surface. The wireless device 414 may be calibrated to transfer and/or receive electrical signals either associated with a particular channel or associated with a channel specific to the sensor 414.

Figure 5A:
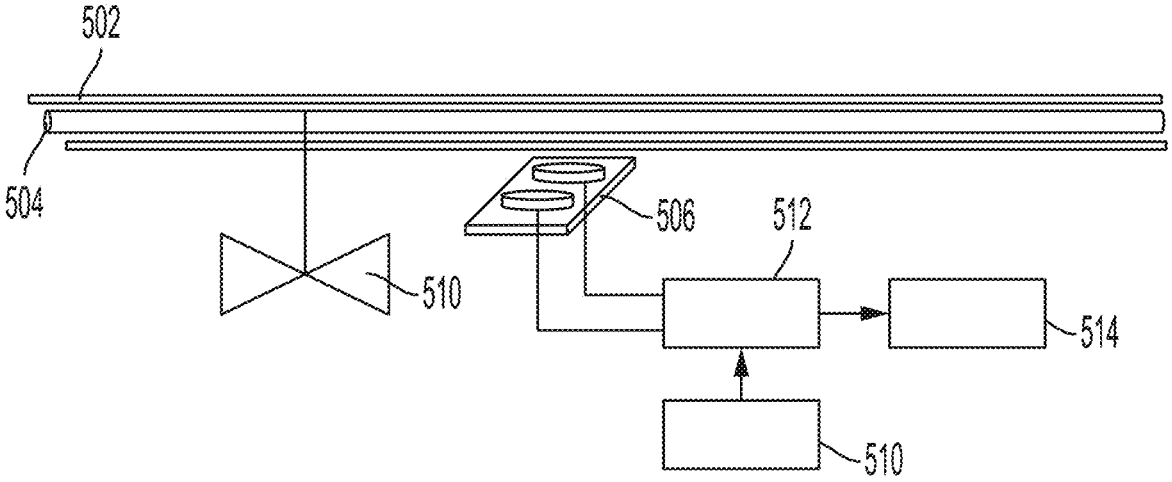
FIG. 5A is a schematic diagram of a portion of a wireless transmission assembly including a field sensor wirelessly coupled to a TEC, for receiving electrical signals from the TEC without hardwiring a wireless device into the TEC, according to one example of the present disclosure.
Figure 5B:
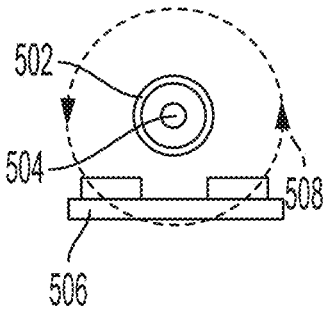
FIG. 5B is an alternate view of the TEC and wireless transmission assembly from FIG. 5A according to one example of the present disclosure.

FIG. 5 is a schematic diagram of a portion of a wireless transmission assembly including a receiver wirelessly coupled to a TEC, for receiving electrical signals from the TEC 502 without hardwiring a wireless device into the TEC 502, according to one example of the present disclosure. A current, illustrated as 'i,' may pass through an electrical conductor 504 within a TEC 502. The TEC 502 originates from the surface 512. The current within the electrical conductor 504 creates a magnetic field 508 around the TEC 502. A magnetic field detector 506 is placed proximal to the TEC 502 such that the magnetic field 508 passes through the magnetic field detector 506. A wired inflow control valve 510 is electrically connected to the electrical conductor 504. within the TEC 502. Electronics 512 are electrically connected to the magnetic field detector 506 and a downhole tool 514. An energy storage device 516 is connected to the electronics 512.

A constant resistive load may be placed at either end of the TEC 502. Data may be encoded in varying current amperages of direct current present within the current. Data encoding may be achieved by varying voltage at a voltage source above the surface 512 from which the TEC 502 originates. Data encoding may also be achieved by changing current flow with the wired ICV 510. Examples of encoded data may include but are not limited to commands to a device or tool downhole. For example, encoded data may correspond to a command to change a fluid restriction, to activate the downhole tool 514, to release the downhole tool 514, to adjust the programming of the downhole tool 514. Encoded data may also include sensor data, for example but not limited to, data corresponding to a draw down rate flow rate, fluid viscosity, pressure, temperature, chemical composition, potential of hydrogen (pH) values, or water composition. The magnetic field 508 passing through the magnetic field detector 506 may possess a time-varying magnetic field that parodies the variations in the current. The magnetic field detector may interpret the time-varying magnetic field to derive the data encoded in the current. The sensor 506 can detect a DC current flowing through the TEC, so the data may be encoded with changes in the level of the DC current flow. Examples of magnetic field detector 506 include Hall effect sensors, magneto-resistive sensors such as giant magnetoresistive sensors (GMR), anisotropic magnetoresistive sensors (AMR), and tunnel magneto-resistive (TMR) sensors, and inductive coil sensors.

Wired electronics, such as the wired ICV 510 may be able to serve as a data hub, capable of receiving data from the surface 512 and routing the data to magnetic field sensors 506 downhole of the ICV 510. The magnetic field sensor 506 may be calibrated to accept electrical signals either associated with a particular channel or associated with a channel specific to the magnetic field sensor 506. The magnetic field sensor 506 may be in electrical communication with a downhole device powered by a turbine.

The electronics 512 may translate commands received by the magnetic field detector 506 from the TEC 502. The electronics 512 may regulate an energy storage 516, such as a chemical battery, so that the electronics 512 can relay commands to the downhole tool 514. Commands may cause the downhole tool 514 to perform a wellbore function, such as setting a packer sleeve, dispensing cement, perforating a geological formation, or gathering a sample. Other wellbore functions are also possible in other examples.

Figure 6:
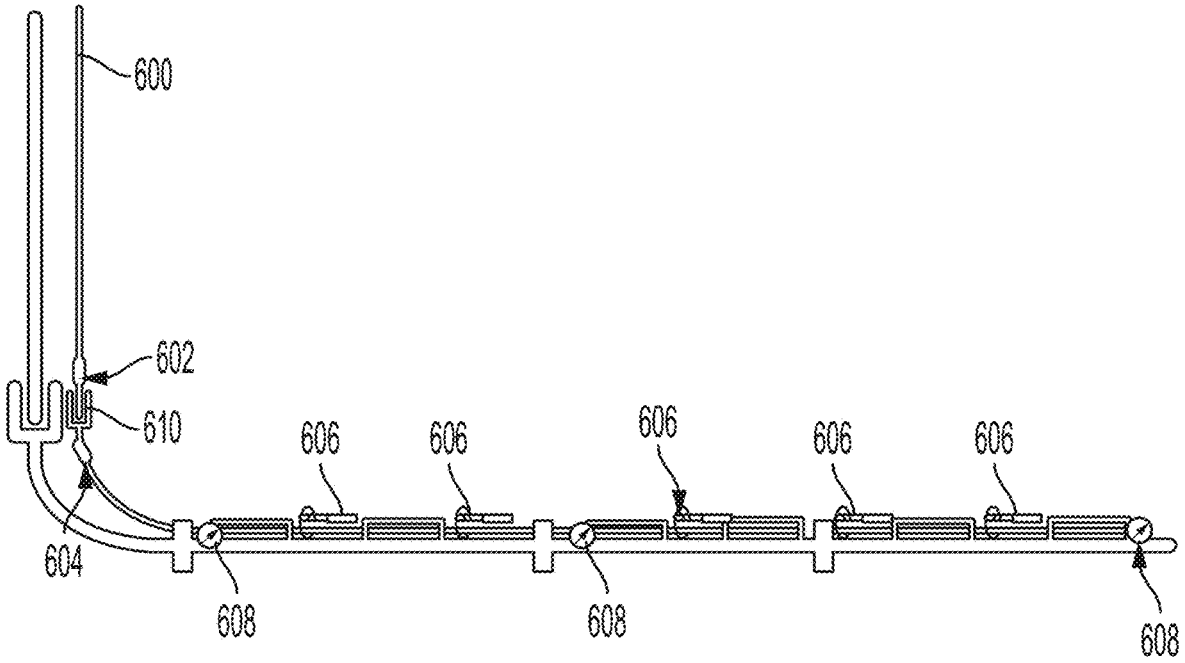
FIG. 6 is a schematic diagram of a portion of a well system including a TEC with a wet connect, inflow control valves wired to an AC portion of the TEC, and electronic inflow control devices wirelessly coupled to the TEC according to one example of the present disclosure.

FIG. 6 is a schematic diagram of a portion of a well system including a TEC with a wet connect, inflow control valves wired to an AC portion of the TEC, and electronic inflow control devices wirelessly coupled to a TEC according to one example of the present disclosure. The electronic inflow control devices are wirelessly coupled to the TEC to communicate with the inflow control valves via the TEC. A direct current flows along the TEC 600, into a direct current to alternating current (DC-AC) transformer 602. An alternating current flows from the DC-AC transformer 602 into a wet connect 610. Downhole from the wet connect, the TEC 600 extends further downhole, connecting to inflow control valve (ICV) nodes 608. Proximal to the portion of the TEC 600 downhole of the DC-AC transformer 602 are electronic inflow control device nodes 606, which may be wirelessly linked to the TEC 600 via a transformer containing at least one ferromagnetic ring encompassing the TEC, or at least one magnetic field detector in range of a magnetic field produced by the TEC 600.

The wet connect 610 may transfer electrical energy via magnetic induction or capacitive charging. The alternating current may optionally flow through a AC-DC transformer 604. The DC-AC transformer 602 and the optional AC-DC transformer 604 may create both a direct current for powering wired ICV nodes 608 as well as an alternating current. Data may be encoded in varying current amperage, voltage amplitude shifts, voltage phase shifts, voltage frequency shifts, timing shifts or other characteristics of alternating currents present within the current 200. Data may be encoded in varying current amperage of a direct current within the TEC. Data encoding may be achieved by varying voltage at a voltage source above a surface from which the TEC originates. Examples of encoded data may include but are not limited to draw down rate flow rate, fluid viscosity, pressure, temperature, chemical composition, potential of hydrogen (pH) values, water composition, or operational status of a wired device.

A magnetic field produced within a ferromagnetic ring or across a magnetic field detector of an electronic inflow control device node 606 may possess varying magnetic flux values that parody the variations in characteristics of the alternating current within the portion of the TEC 600 downhole of the DC-AC transformer 602. The electronic inflow control device node 606 may interpret data encoded in the variations of characteristics of the alternating current. The electronic inflow control device nodes 606 or ICV nodes 608 may be calibrated to accept electrical signals either associated with a particular channel or associated with a channel specific to a given electronic inflow control device node 606 or ICV node 608.

In some aspects, systems for wireless transmission and reception of electrical signals via tubing encased conductor are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a tubing encased conductor (TEC); a transformer configured to inductively couple to the TEC; and a downhole device, coupled to the transformer, the downhole device comprising a transceiver configured to receive, from the transformer, digital signals encoded in a variable current in the TEC.

Example 2 is the system of example(s) 1, wherein the transceiver of the downhole device is further configured to transmit digital signals encoded in an alternating current to an at least one additional downhole device electrically coupled to the TEC.

Example 4 is the system of any of example(s) 1-2, further comprising a second transformer inductively coupled to the TEC, configured to transmit digital signals encoded in an alternating current of the TEC.

Example 4 is the system of any of example(s) 1-2, further comprising a wired downhole tool configured to couple to the TEC, the wired downhole tool configured to transmit digital signals corresponding to a command to the downhole device.

Example 5 is the system of any of example(s) 1-4, wherein digital signals encoded in an alternating current are encoded via variations in voltage, frequency, phase, or any other suitable parameter of the alternating current.

Example 6 is the system of any of example(s) 1-5, wherein the downhole device is configured to receive electrical power via the transformer.

Example 7 is the system of any of example(s) 1-6, wherein digital signals are encoded in an alternating current and are configured to traverse a direct current.

Example 8 is the system of any of example(s) 1-7, wherein digital signals transmitted by a wired downhole tool to the downhole device are of a higher frequency than digital signals originating from or directed to a processor at a surface.

Example 9 is the system of any of example(s) 1-8, further comprising: a direct current to alternating current transformer coupled above a wet-connect using an AC wet connect, an alternating current to direct current transformer coupled below the wet-connect for providing a direct current power source for the downhole device wired to the TEC; and an alternating current source for communication with the downhole device.

Example 10 is a system comprising: a tubing encased conductor (TEC); a transformer configured to inductively couple to the TEC; and a downhole device, coupled to the transformer, the downhole device comprising a transceiver configured to transmit, from the transformer, digital signals encoded in a variable current in the TEC.

Example 11 is the system of example(s) 10, wherein the transceiver of the downhole device is further configured to receive data from an at least one additional downhole device electrically coupled to the transceiver.

Example 12 is the system of any of example(s) 10-11, further comprising a second transformer inductively coupled to the TEC, configured to receive digital signals encoded in an alternating current of the TEC.

Example 13 is the system of any of example(s) 10-12, further comprising a capacitor coupled to the downhole device, configured to supply energy for transmission of digital signals encoded in an alternating current of the TEC.

Example 14 is the system of any of example(s) 10-13, wherein the digital signals are encoded in an alternating current and are encoded via variations in voltage, frequency, phase, or any other suitable parameter of the alternating current.

Example 15 is the system of any of example(s) 10-14, wherein the downhole device is configured to receive electrical power via the transformer.

Example 16 is the system of any of example(s) 10-15, wherein digital signals are encoded in an alternating current and are configured to traverse a direct current.

Example 17 is the system of any of example(s) 10-16, wherein digital signals received by a wired downhole tool to the downhole device are of a higher frequency than digital signals originating from or directed to a processor at a surface.

Example 18 is the system of any of example(s) 10-17, further comprising: a direct current to alternating current transformer coupled above a wet-connect using an AC wet connect, and an alternating current to direct current transformer coupled to the wet-connect for providing a direct current power source for the downhole device wired to the TEC as well as providing an alternating current electrical signal in addition to the direct current for communication with the downhole device.

Example 19 is a system comprising: a tubing encased conductor (TEC) for transmitting a direct current; a wireless device positioned downhole comprising: a magnetic sensor for wirelessly receiving a digital signal encoded in the direct current of the TEC, for controlling the wireless device positionable downhole; and a wired downhole tool coupled to the TEC, the wired downhole tool configured to transmit the digital signal to the wireless device positionable downhole via the TEC.

Example 20 is the system of example(s) 19, wherein the digital signal is encoded in the direct current via varying current amperage of the direct current.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a tubing encased conductor (TEC) extending from a surface into a wellbore and configured to convey a variable alternating current simultaneously with a direct current;

a harvesting transformer configured to inductively couple to the TEC and to harvest energy from electric current flowing therein, the harvesting transformer comprising:

a ferromagnetic harvesting ring that surrounds the TEC and is positionable in a magnetic field of the variable alternating current such that a magnetic flux associated with the magnetic field is concentrated in the harvesting ring; and a harvesting coil comprising a coil of wire around a portion of the harvesting ring to convey an electric current induced in the harvesting coil by the magnetic field in the harvesting ring;

a transmitting transformer configured to inductively couple to the TEC and to transmit data from a wireless device, the transmitting transformer comprising:

a ferromagnetic transmitting ring that surrounds the TEC and is positionable in a magnetic field of the variable alternating current such that a magnetic flux associated with the magnetic field is concentrated in the transmitting ring; and a transmitting coil comprising a coil of wire around a portion of the transmitting ring to convey an electric current induced in the transmitting coil by the magnetic field in the transmitting ring;

a downhole wireless device coupled to the harvesting ring by the harvesting coil and thereby wirelessly coupled to the TEC by the harvesting transformer, the downhole wireless device comprising a transceiver configured to receive, via the harvesting transformer, digital signals encodable in the variable alternating current in the TEC;

a downhole wired device hardwired to the TEC, the downhole wired device powerable by the direct current, and serving as a data hub for transmitting data between the downhole wireless device and the surface;

a voltage source electrically connected to the transmitting coil;

an electrical energy storage device electrically connected between the wireless device and the voltage source; and wherein the wireless device is powerable by the induced current in the harvesting coil and the electrical energy storage device is chargeable by the induced current in the harvesting coil.

2. The system of claim 1, wherein the transceiver of the downhole wireless device is further configured to transmit the digital signals encoded in the alternating current to at least one additional downhole wireless device electrically coupled to the TEC.

3. The system of claim 1, wherein:

the transmitting transformer is configured to transmit digital signals encoded in the alternating current of the TEC; and electrical energy stored in the electrical energy storage device is usable by the voltage source to amplify an electrical signal across the transmitting coil at a time of transmission of a digital signal from the wireless device to the surface by the transmitting transformer.

4. The system of claim 1, wherein the downhole wired device is configured to transmit digital signals corresponding to a command to the downhole wireless device.

5. The system of claim 1, wherein the digital signals encoded in the alternating current are encoded via variations in voltage, frequency, phase, or any other suitable parameter of the alternating current, and data is encoded in the direct current via variations in the amperage of the direct current.

6. The system of claim 1, wherein:

the TEC extends into the wellbore, turns, and returns to the surface;

a first leg of the TEC extends from the surface to the turn and carries an input voltage;

the harvesting ring surrounds the first leg of the TEC;

a second leg of the TEC extends from the turn to the surface and carries an output voltage; and the transmitting ring surrounds the second leg of the TEC.

7. The system of claim 1, wherein the ferromagnetic harvesting and/or transmitting ring includes a material selected from the group consisting of ferrite, nickel, nickel-iron alloys, iron, steel, and combinations thereof.

8. The system of claim 1, wherein the downhole wired device is configured to transmit digital signals to the downhole wireless device that are of a higher frequency than digital signals originating from or directed to a processor at the surface.

9. The system of claim 1, further comprising:

a direct current to alternating current transformer coupled above a wet-connect using an AC wet connect for providing alternating current electrical energy for powering the downhole wireless device;

an alternating current to direct current transformer coupled below the wet-connect for providing direct current electrical energy for powering the downhole wired device; and a direct current source electrically connected to the TEC at the surface.

10. A method comprising:

extending a tubing encased conductor (TEC) extending from a surface into a wellbore the TEC conveying a variable alternating current simultaneously with a direct current;

inductively coupling a harvesting transformer to the TEC, the harvesting transformer comprising:

a ferromagnetic harvesting ring that surrounds the TEC and is positioned in a magnetic field of the variable alternating current such that a magnetic flux associated with the magnetic field is concentrated in the harvesting ring; and a harvesting coil comprising a coil of wire around a portion of the harvesting ring, the harvesting coil conveying an electric current induced in the harvesting coil by the magnetic field in the harvesting ring;

inductively coupling a transmitting transformer to the TEC, the transmitting transformer comprising:

a ferromagnetic transmitting ring that surrounds the TEC and is positioned in a magnetic field of the variable alternating current such that a magnetic flux associated with the magnetic field is concentrated in the transmitting ring; and a transmitting coil comprising a coil of wire around a portion of the transmitting ring, the transmitting coil conveying an electric current induced in the transmitting coil by the magnetic field in the transmitting ring;

providing a downhole wireless device coupled to the harvesting ring by the harvesting coil and thereby wirelessly coupled to the TEC by the harvesting transformer, the downhole wireless device comprising a transceiver that transmits, via the harvesting transformer, digital signals encoded in the variable alternating current in the TEC;

providing a downhole wired device hardwired to the TEC, the downhole wired device powered by the direct current, and serving as a data hub that transmits data between the downhole wireless device and the surface;

electrically connecting a voltage source to the transmitting coil;

electrically connecting an electrical energy storage device between the wireless device and the voltage source; and wherein the induced current in the harvesting coil powers the wireless device and charges the electrical energy storage device.

11. The method of claim 10, wherein the transceiver of the downhole wireless device receives data from at least one additional downhole wireless device electrically coupled to the transceiver.

12. The method of claim 10, wherein:

the transmitting transformer receives digital signals encoded in an alternating current of the TEC; and electrical energy stored in the electrical energy storage device is used by the voltage source to amplify an electrical signal across the transmitting coil when the transmitting transformer transmits a digital signal from the wireless device to the surface.

13. The method of claim 10, wherein the electrical energy storage device is a capacitor.

14. The method of claim 10, wherein the digital signals are encoded in the alternating current and are encoded via variations in voltage, frequency, phase, or any other suitable parameter of the alternating current, and data is encoded in the direct current via variations in the amperage of the direct current.

15. The method of claim 10, wherein;

the TEC makes a turn in the wellbore and returns to the surface;

a first leg of the TEC extends from the surface to the turn and carries an input voltage;

the harvesting ring surrounds the first leg of the TEC;

a second leg of the TEC extends from the turn to the surface and carries an output voltage; and the transmitting ring surrounds the second leg of the TEC.

16. The method of claim 10, wherein the ferromagnetic harvesting and/or transmitting ring includes a material selected from the group consisting of ferrite, nickel, nickel-iron alloys, iron, steel, and combinations thereof.

17. The method of claim 10, wherein the downhole wired device receives digital signals from the downhole wireless device that are of a higher frequency than digital signals originating from or directed to a processor at a surface.

18. The method of claim 10, further comprising:

coupling a direct current to alternating current transformer above a wet-connect using an AC wet connect, the direct current to alternating current transformer providing alternating current electrical energy that powers the downhole wireless device; and coupling an alternating current to direct current transformer to the wet-connect, the alternating current to direct current transformer providing direct current electrical energy that powers the downhole wired device and providing an alternating current electrical signal in addition to the direct current that is used to communicate with the downhole wireless device.

* * * * *